US006343597B1

(12) United States Patent
Spikes

(10) Patent No.: US 6,343,597 B1
(45) Date of Patent: Feb. 5, 2002

(54) TOY CATAPULT GAME

(76) Inventor: Michael D. Spikes, 505 SE. Vera, Corvallis, OR (US) 97333

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/118,238

(22) Filed: Jul. 17, 1998

Related U.S. Application Data

(60) Provisional application No. 60/053,172, filed on Jul. 18, 1997.

(51) Int. Cl.[7] ..... F41B 3/03
(52) U.S. Cl. ..... 124/7; 124/16
(58) Field of Search ..... 124/4, 6, 7, 16, 124/17, 36

(56) References Cited

U.S. PATENT DOCUMENTS

| | | | | | |
|---|---|---|---|---|---|
| 1,162,910 | A | * | 12/1915 | Goude | 124/7 |
| 2,080,958 | A | * | 5/1937 | Beasley et al. | 124/7 |
| 2,082,818 | A | * | 6/1937 | Atwell | 124/4 X |
| 2,963,016 | A | * | 12/1960 | Andis | 124/4 X |
| 3,262,439 | A | * | 7/1966 | Johns | 124/7 |
| 3,638,633 | A | | 2/1972 | Clark | 124/4 |
| 3,794,325 | A | * | 2/1974 | Stender | 124/7 X |
| 3,841,292 | A | | 10/1974 | Hoffman | 124/5 |
| 3,973,774 | A | | 8/1976 | Breslow et al. | 124/79 |
| 3,974,820 | A | | 8/1976 | Ott | 124/20.1 |
| 4,052,065 | A | | 10/1977 | Rodriquez | 273/341.1 |
| 4,111,179 | A | * | 9/1978 | Hashimoto | 124/7 |
| 4,303,247 | A | | 12/1981 | Fain | 473/511 |
| 4,411,248 | A | | 10/1983 | Kivenson | 124/20.1 |
| 4,583,743 | A | | 4/1986 | Macek | 273/368 |
| D288,215 | S | | 2/1987 | Tami | D21/385 |
| 4,860,717 | A | * | 8/1989 | Powell et al. | 124/7 |
| 4,922,884 | A | | 5/1990 | Ford | 124/20.1 |
| D328,764 | S | | 8/1992 | Klitsner | D21/454 |
| 5,299,966 | A | | 4/1994 | Rose, III | 446/62 |
| D366,908 | S | | 2/1996 | Crennen | D21/454 |
| 5,676,120 | A | * | 10/1997 | Joseph | 124/6 |
| D398,937 | S | | 9/1998 | Spikes | D21/301 |

* cited by examiner

*Primary Examiner*—John A. Ricci
(74) *Attorney, Agent, or Firm*—Kolisch Hartwell Dickinson McCormack & Heuser

(57) ABSTRACT

A toy catapult includes a frame and an elongate arm. One end of the arm includes a wheel that is rotatable on an axis defined by a bar of the frame. The other end of the arm includes a ball holder. An aim-protection member is also circumferentially attached to the aim near its middle. The frame includes dual block members, each having a post member extending vertically from it, and a stop member positioned between the post members. Interposing the block members is a lever arm with a wheel-engagement member for holding the arm in tensed, or cocked position. Tension is caused by a flexible bias member which attaches to the arm and to a hook positioned on the frame and located forward of the wheel.

1 Claim, 3 Drawing Sheets

TOY CATAPULT GAME

Cross-Reference to Related Applications

This application claims priority from U.S. Provisional Patent Application Serial No. 60/053,172 entitled "TOY CATAPULT GAME" which was filed on Jul. 18, 1997.

BACKGROUND AND SUMMARY OF THE INVENTION

This invention relates generally to games, and more particularly to a toy catapult and game.

Various features and other objects and advantages which are attained by the structure and method of the invention will become more fully apparent as the description that now follows is read in conjunction with the several drawing figures, and the attachment that collectively form part of this disclosure.

DETAILED DESCRIPTION OF THE EMBODIMENT AND THE PREFERRED MANNER OF PRACTICING THE INVENTION

In addition to the following description of the above-identified drawings, the present application also includes attachment A which provides textual and graphic information about the background of the invention, and a further description of the toy catapult, and the game of the invention.

Figure 1:
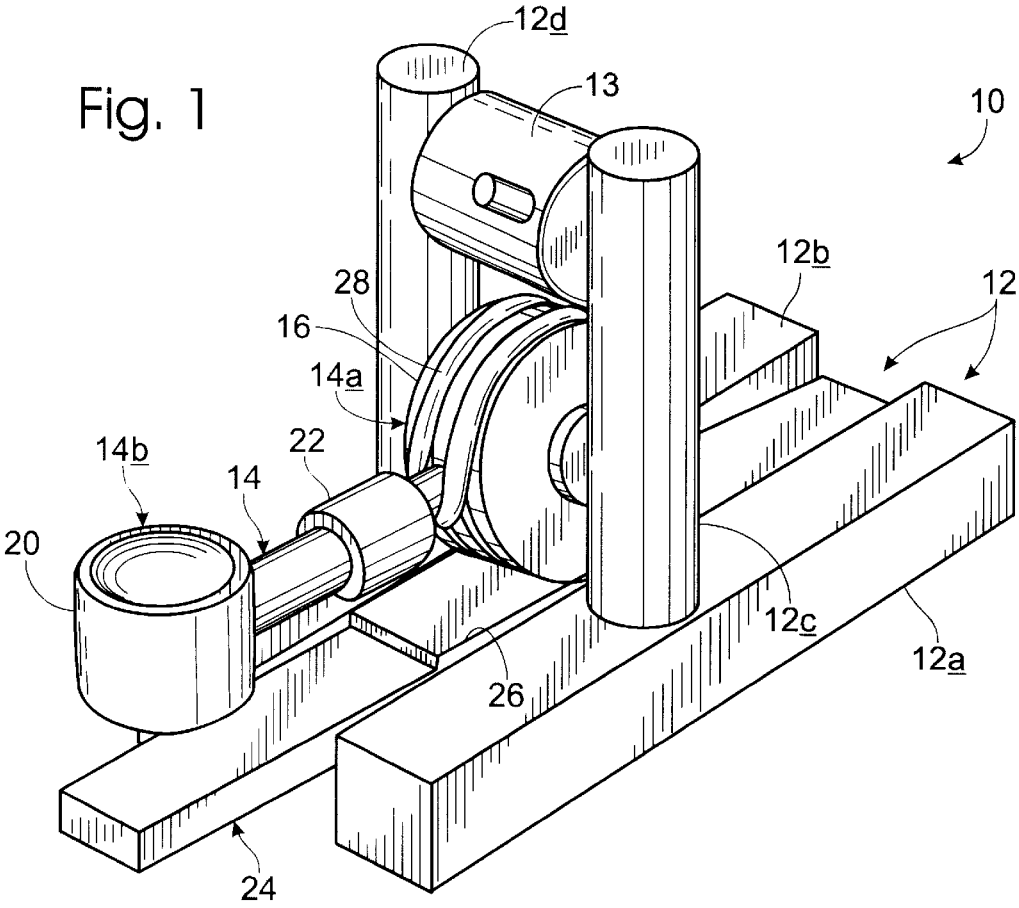
FIG. 1 is an isometric view of an embodiment of the invention.

Referring to FIG. 1, a toy catapult 10 includes a frame 12 and an elongate arm 14. One end 14*a* of arm 14 includes a wheel 16 that is rotatable on an axis defined by a bar (undepicted but like bar 118*a* of FIG. 6) of frame 12. The other end 14*b* of the arm includes a ball holder 20. An arm-protection member 22 is also circumferentially attached to the arm near its middle. Frame 12 includes dual block members 12*a*, 12*b*, each having a corresponding post member 12*c*, 12*d* extending vertically from it. The frame also includes stop member 13 which mounts on a bar (undepicted but like bar 118*b* of FIG. 6)

Figure 3:
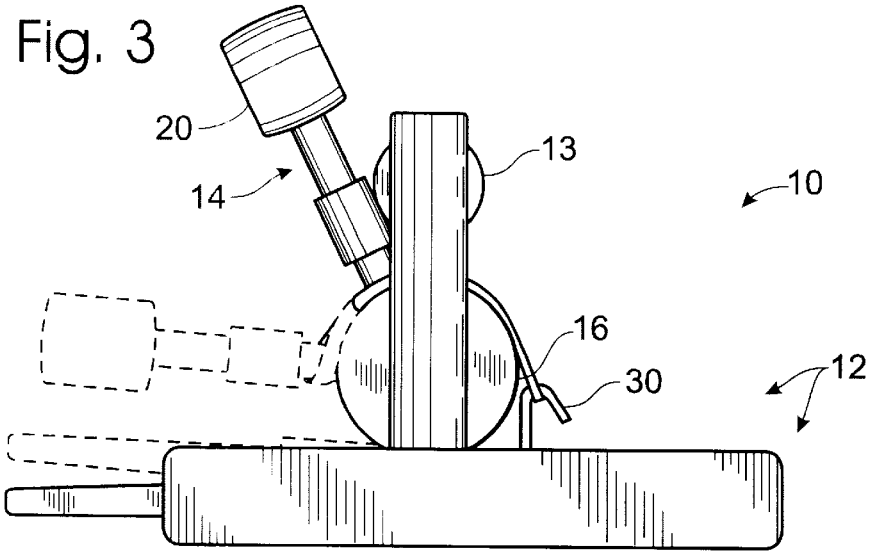
FIG. 3 is a side elevational view of the invention shown in FIG. 1.

Interposing the block members is a lever arm 24 with a wheel-engagement member 26 for holding the arm in tensed, or cocked position. Tension is caused by a flexible bias member, such as a suitable rubber band 28 which attaches to the arm and to a hook 30 (FIG. 3) positioned on the frame and located forward of the wheel. Member 26 engages a suitable, complementary notch formed in a section of wheel 16 (see FIG. 6) so that it is effective to hold arm 14 in the cocked position shown in FIG. 6. Lever arm pivots on an axis defined by a bar (undepicted but like bar 188*c* shown in FIG. 6). By pressing lever arm 24 downward from a cocked position (see dashed lines in FIG. 3) to a release position (see solid line depiction in FIG. 3), arm 14 will rotate clockwise at a preselected speed until it contacts stop member 13. The preselected force with which arm 14 imparts to stop member 13 will cause a ball resting in ball holder 20 to be thrown a preselected distance.

Figure 6:
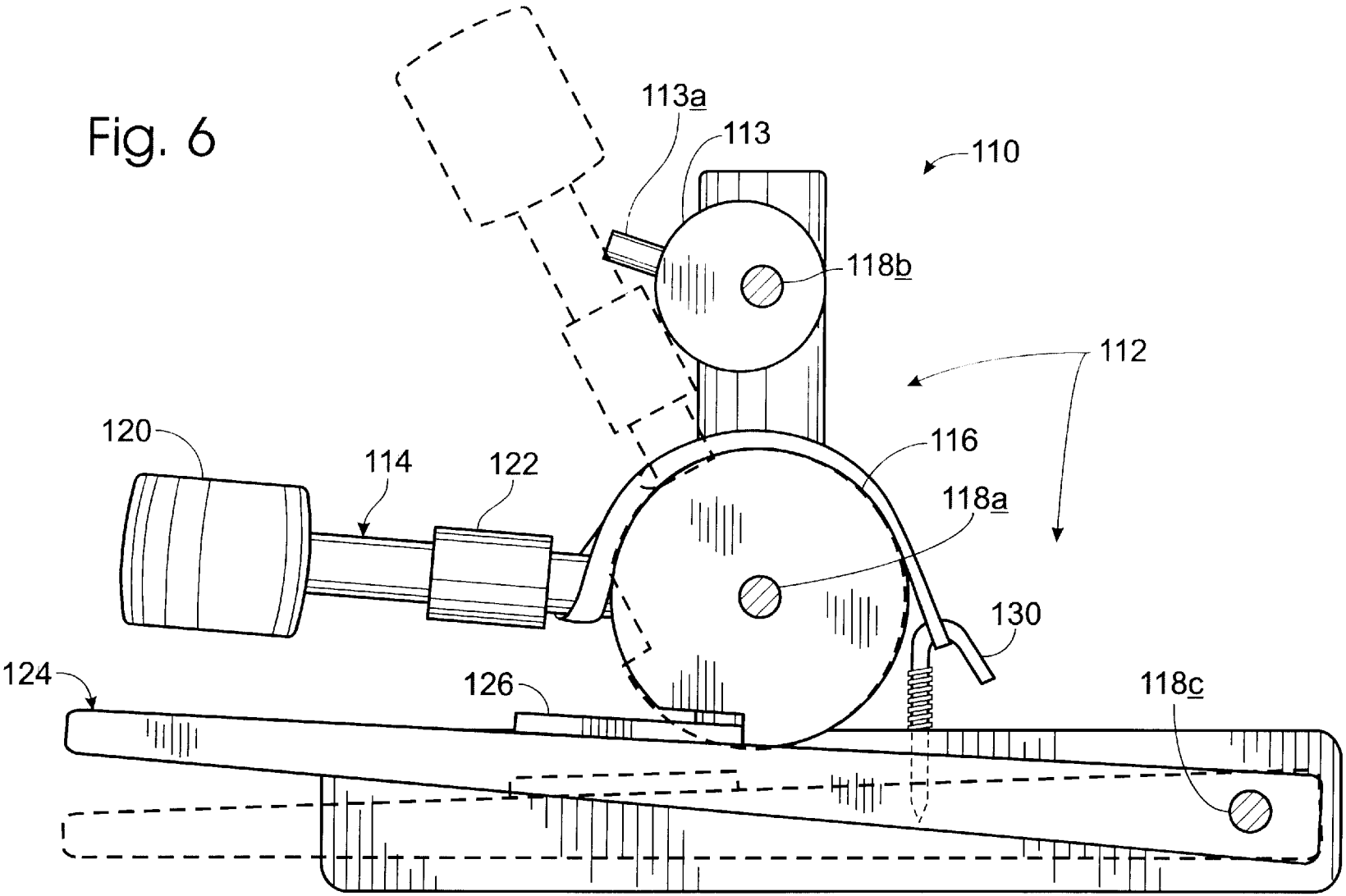
FIG. 6 is a side elevational view like FIGS. 4–5, but on a larger scale, showing a catch mechanism.

The invention may also be thought of as a toy catapult 10 for use with a ball, comprising a frame 12 including a rotational-axis-defining region (wheel 16 and a bar like bar 118*a* in FIG. 6). Catapult 10 also includes an elongate arm 14 with first and second ends 14*a*, 14*b* and a middle region. First end 14*a* (including wheel 16) is constructed to be rotatable about an axis defined by the rotational-axis-defining region (particularly a bar like bar 118*a* in FIG. 6), and second end 14*b* being constructed to hold a ball. An arm-protection member 22 is circumferentially attached to elongate arm 14 near the middle region; and a lever arm 24 is associated with frame 12 includes an arm-engagement member for releasably holding elongate arm 14 in a cocked position. The lever arm is actuable to release the elongate arm from the cocked position to cause the ball to be thrown from the second end of the elongate arm.

Figure 2:
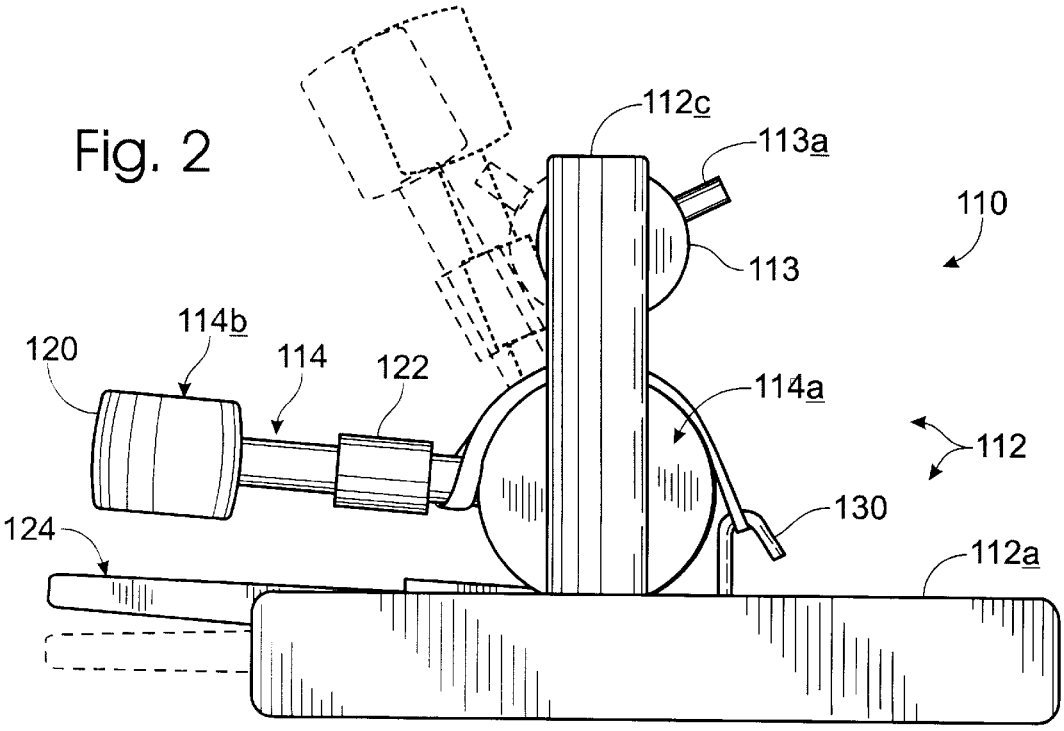
FIG. 2 is a side elevational view of another embodiment of the invention.
Figure 4:
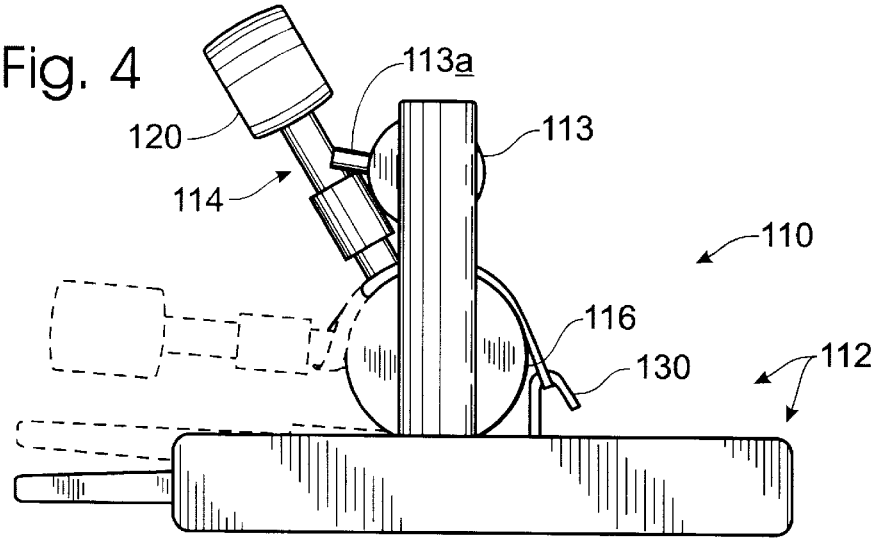
FIGS. 4–5 are side elevational views of the invention shown in FIG. 2, with certain operational features shown.
Figure 5:
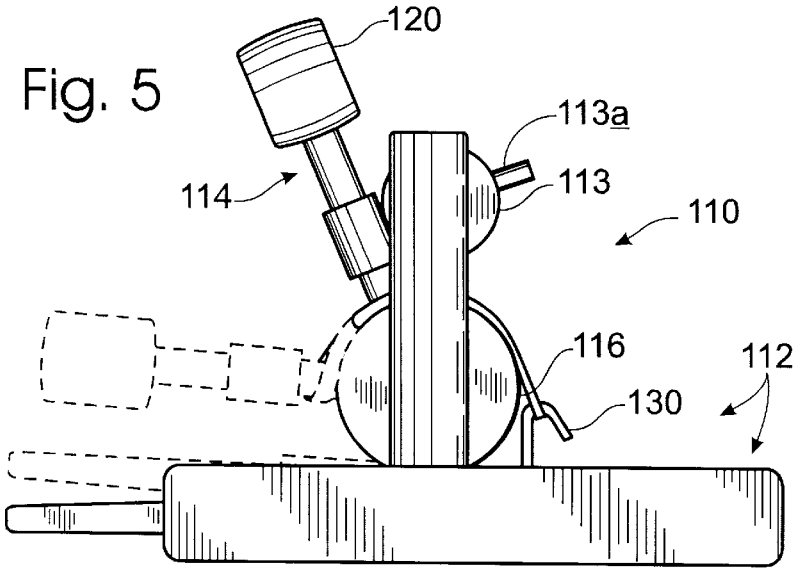

FIG. 2 shows an alternate embodiment of the invention at 110 with an off-axis mounted stop member 113 including a stop-set member 113*a* for setting the stop member at a desired position to change the distance that arm 114 will travel before it contacts stop member 113 (see FIG. 4 (shorter distance) and FIG. 5 (longer distance)). Stop-set member 113*a* is hand manipulable, and stop member 113 rotates freely on bar 118*b* (see FIG. 6).

In the present description, it should be understood that any suitable material could be used for the toy catapult, i.e. wood, plastic, etc., and any suitable fastening means could be used to assemble the various components. For the preferred version, it is presently required to allow the wheel, stop and lever to rotate/pivot about their corresponding axes (i.e. see bars 118*a*–118*c* in FIG. 6)

I claim:

1. A toy catapult for use with a ball, comprising:

a frame including a rotational-axis-defining region;

an elongate arm movable to a cocked position, the elongate arm including first and second ends and a middle region, the first end being constructed to be bi-directionally rotatable about a rotation axis defined by the rotational-axis-defining region,and the second end being constructed to hold the ball;

an arm-protection member circumferentially attached to the arm near the middle region;

a bias member for placing a desired amount of tension on the elongate arm when it is moved to the cocked position;

an actuator lever associated with the frame and including an arm-engagement member for releasably holding the elongate arm in the cocked position; wherein the actuator lever is actuable to release the elongate arm from the cocked position, with the tension from the bias member causing the released elongate arm to rotate about the rotation axis away from the actuator lever;

a stop member associated with the frame and located in a position that is effective to stop the elongate arm by contact with the arm-protection member after the elongate arm rotates a desired distance from the cocked position, thereby to cause the ball to be thrown from the second end of the elongate arm, with contact between the stop member and the arm-protection member tending to reduce any force exerted on the elongate arm when it is stopped by the stop member; and wherein the stop member is selectively positionable in plural stop positions to allow the elongate arm to rotate selected distances before contact between the stop member and the arm-protection member.

* * * * *